US006356015B2

(12) United States Patent
Davenport

(10) Patent No.: US 6,356,015 B2
(45) Date of Patent: Mar. 12, 2002

(54) GETTER FLASH SHIELD

(75) Inventor: Eric P Davenport, Van Etten, NY (US)

(73) Assignee: Imaging & Sensing Technology Corporation, Horseheads, NY (US)

( * ) Notice: Subject to any disclaimer, the term of this patent is extended or adjusted under 35 U.S.C. 154(b) by 0 days.

(21) Appl. No.: 09/884,116

(22) Filed: Jun. 19, 2001

Related U.S. Application Data

(63) Continuation of application No. 09/235,021, filed on Jan. 21, 1999, now abandoned.

(51) Int. Cl.[7] ..... H01J 61/04

(52) U.S. Cl. ..... 313/560; 313/356; 313/558; 313/559

(58) Field of Search ..... 313/560, 356, 313/559, 558

(56) References Cited

U.S. PATENT DOCUMENTS

| | | | |
|---|---|---|---|
| 3,866,079 | A | 2/1975 | Schut |
| 3,868,593 | A | 2/1975 | Fukuda et al. |
| 3,882,348 | A | 5/1975 | Paridaens |
| 3,885,191 | A | 5/1975 | Kerstetter |
| 3,909,655 | A | 9/1975 | Grimmett et al. |
| 3,928,784 | A | 12/1975 | Weijland |
| 3,934,167 | A | 1/1976 | Ponsen et al. |
| 3,942,059 | A | 3/1976 | Tran-Quang |
| 3,969,650 | A | 7/1976 | Chodil et al. |
| 4,034,261 | A | 7/1977 | Lutz et al. |
| 4,040,708 | A | 8/1977 | Neuber et al. |
| 4,066,310 | A | 1/1978 | Palac |
| 4,071,802 | A | 1/1978 | Yamasaki |
| 4,158,790 | A | 6/1979 | Sullivan |
| 4,216,438 | A | 8/1980 | Seki et al. |
| 4,318,024 | A | 3/1982 | Rech et al. |
| 4,352,043 | A | 9/1982 | Rigden |
| 4,459,508 | A | 7/1984 | Ichikawa et al. |
| 4,461,970 | A | 7/1984 | Anderson |
| 4,479,073 | A | 10/1984 | Van Daelen |
| 4,506,194 | A | 3/1985 | Rigden et al. |
| 4,510,608 | A | 4/1985 | Fujii et al. |
| 4,651,336 | A | 3/1987 | Le Guen et al. |
| 4,728,862 | A | 3/1988 | Kovarik et al. |
| 4,795,942 | A | 1/1989 | Yamasaki |
| 4,833,366 | A | 5/1989 | Wu et al. |
| 4,857,796 | A | 8/1989 | Amano et al. |
| 4,945,283 | A | 7/1990 | Van Der Heijden et al. |
| 4,947,403 | A | 8/1990 | Ishihara et al. |
| 4,955,045 | A | 9/1990 | Friede et al. |
| 4,961,023 | A | 10/1990 | Vrijssen et al. |
| 4,988,910 | A | 1/1991 | Gabioud |
| 5,046,186 | A | 9/1991 | Rohmfeld |
| 5,134,641 | A | 7/1992 | Friede et al. |
| 5,180,946 | A | 1/1993 | Aiga et al. |
| 5,185,552 | A | 2/1993 | Suzuki et al. |
| 5,202,606 | A | 4/1993 | Vrijssen et al. |
| 5,317,233 | A | 5/1994 | Lien et al. |
| 5,431,802 | A | 7/1995 | Sukimoto et al. |
| 5,686,789 | A | 11/1997 | Schoenbach et al. |
| 5,686,795 | A | 11/1997 | Sakoske et al. |
| 5,767,625 | A | 6/1998 | Shrader et al. |
| 5,773,924 | A | 6/1998 | Nakamura |

*Primary Examiner*—Ashok Patel
(74) *Attorney, Agent, or Firm*—Nixon Peabody LLP

(57) ABSTRACT

The invention is directed to an improved hollow cathode lamp (15). In the preferred embodiment, the lamp is comprised of a stem (23), a cathode lead (18) which passes through the stem, and a getter (26). The improvement includes a flash shield (28) positioned between the getter and the stem, whereby the flash shield will limit the deposit of getter metal on the stem when the getter flashes. The flash shield may be a circular disk and composed of nickel. The flash shield may include an evacuation passage (46). The flash shield may also be capable of being heated to about 1000° C. during flashing, whereby the flash shield may be heated so as to convectionally repel the getter metal when the getter flashes.

17 Claims, 2 Drawing Sheets

GETTER FLASH SHIELD

This application is a continuation of Ser. No. 09,235,021 filed on Jul. 21, 1999, now abandoned.

FIELD OF THE INVENTION

The present invention relates generally to the field of hollow cathode lamps and, more particularly, to an improved hollow cathode lamp which limits the deposition of flashed getter metals on the stem and cathode leads of the lamp.

BACKGROUND ART

A variety of designs are known for hollow cathode lamps. Hollow cathode lamps used in extreme conditions are often designed such that two cathode leads and two anode leads carry electrical energy from the power supply, through the glass stem of the lamp, to the cathode and anode inside the lamp. It is known that hollow cathode lamps which must operate for extended periods of time and from which a high-quality spectrum is required (i.e., spectra calibration lamps for satellite instruments) should include a getter to collect contaminant gases after the lamp is sealed. It is known that a getter can extend the service life of the lamp by assuring that the spectra of the lamp will not become contaminated with hydrogen, oxygen, or water vapor that diffuses from the internal components. The getter, composed of a reactive metal such as barium, is heated until the metal vaporizes, or flashes, inside the lamp, thereby trapping any foreign gases in a location where they cannot enter the spectra.

In the prior art, some of the vaporized or flashed getter metal will form a film on the cathode leads. This contact produces a negative potential in the getter film. As an unfortunate result, the electrical discharge of the lamp may occur between the anode and the getter film, rather than between the anode and the cathode. In effect, the getter film will operate as the cathode. Because it is necessary to have the cathode metal produce the emitted spectra, rather than the getter metal, a discharge between the anode and the getter-metal film renders the lamp useless. Hence, it would be useful to provide a hollow cathode lamp with a flash shield that limits the deposition of the getter metal on the cathode leads and stem so as to prevent the getter metal from obtaining a negative potential and, thereby interfering with the proper operation of the lamp.

DISCLOSURE OF THE INVENTION

With parenthetical reference to the corresponding parts, portions or surfaces of the disclosed embodiment, merely for the purposes of illustration and not by way of limitation, the present invention provides an improved hollow cathode lamp (15) having a stem (23), a cathode lead (18) which passes through the stem, and a getter (26). The improvement comprises a flash shield (28) positioned between the getter and the stem, whereby the flash shield will limit the deposit of getter metal on the stem when the getter flashes.

The flash shield may be a circular disk and composed of nickel. The flash shield may include an evacuation passage (46). The flash shield may also be capable of being heated to about 1000° C. during flashing, whereby the flash shield may be heated so as to convectionally repel the getter metal when the getter flashes.

Accordingly, the general object of the present invention is to provide an improved hollow cathode lamp with a flash shield which limits the deposit of getter metal on the stem and cathode leads of the lamp when the getter flashes.

Another object is to provide an improved hollow cathode lamp with a flash shield which is capable of being heated so as to convectionally limit the deposit of getter metal on the stem when the getter flashes.

Another object is to provide an improved hollow cathode lamp with internal supports which provide stability to the internal components of the lamp.

Another object is to provide an improved hollow cathode lamp which prevents the getter metal from obtaining a negative potential.

Another object is to provide an improved hollow cathode lamp with a flash shield which allows for unrestricted evacuation of the bulb when sealing the lamp.

Another object is to provide an improved hollow cathode lamp with a flash shield which allows for high pumping speeds during evacuation.

These and other objects and advantages will become apparent from the foregoing and ongoing written specification, the drawings, and the appended claims.

DESCRIPTION OF THE PREFERRED EMBODIMENTS

Figure 2:
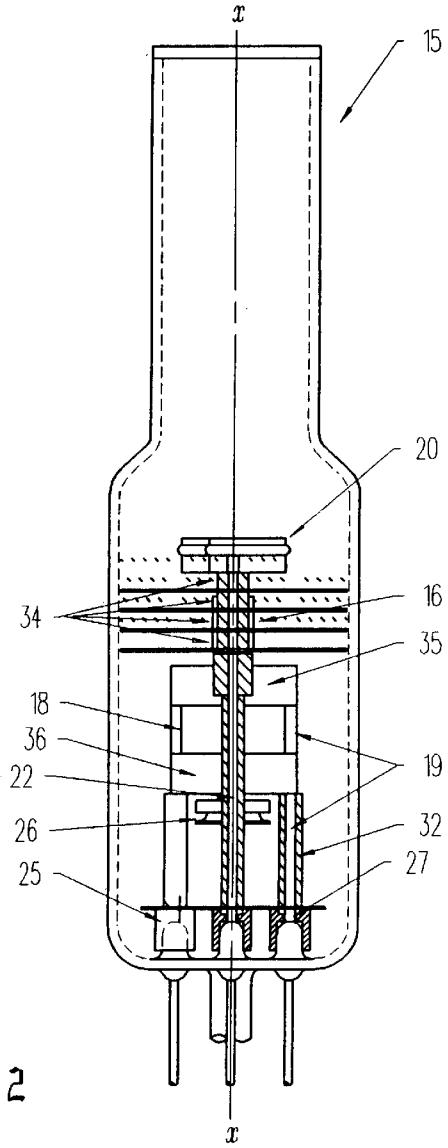
FIG. 2 is a right side view, partially in verticle section and partially in elevation, of the improved hollow cathode lamp shown in FIG. 1.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or access of rotation, as appropriate.

Figure 1:
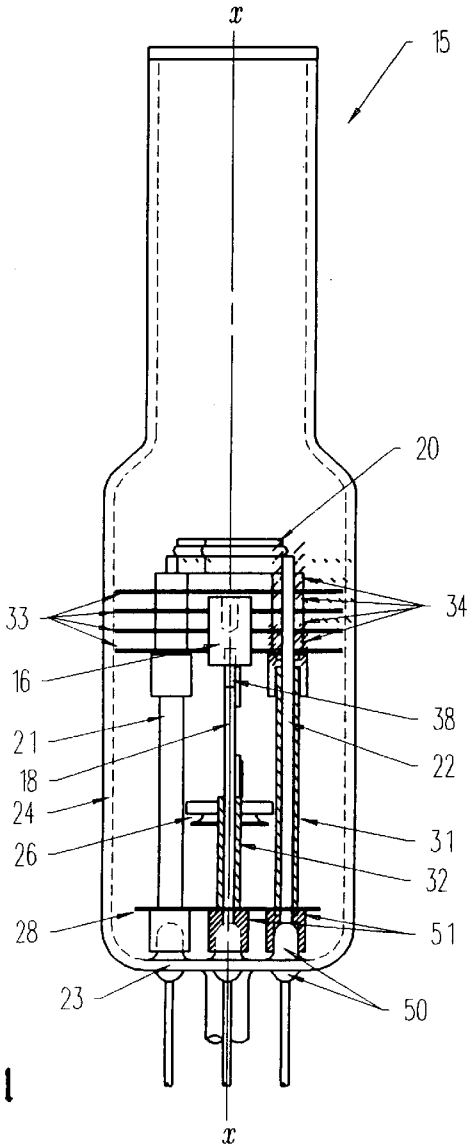
FIG. 1 is a view, partially in verticle section and partially in elevation, of the improved hollow cathode lamp.

Referring now to the drawings and, more particularly, to FIGS. 1–2, this invention provides an improved hollow cathode lamp, of which the presently preferred embodiment is generally indicated at 15. Lamp 15 is shown as broadly including a cathode 16, an anode 20, a getter 26, a flash shield 28, a glass stem 23, and a glass bulb 24. Cathode 16, anode 20, getter 26, flash shield 28, stem 23, and bulb 24 are annular members generated about verticle axis x—x. Stem 23 is an annular glass disk. Bulb 24 is a cylindrical member which is attached at its bottom marginal end to stem 23 along the outer diameter of stem 23.

Figure 5:
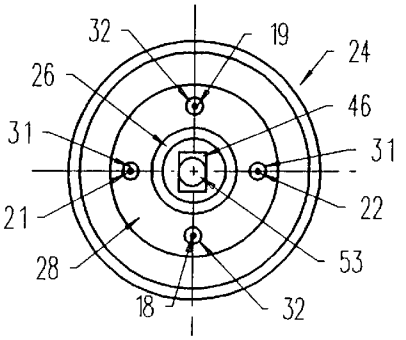
FIG. 5 is a horizontal sectional view of the hollow cathode lamp shown in FIG. 4*b*, taken generally on line 5—5 of FIG. 4*b*.

Four electrical leads 18, 19, 21 and 22 carry electrical energy from a power supply (not shown) to cathode 16 and anode 20. Two opposed anode leads 21, 22 supply electrical energy to anode 20, and two opposed cathode leads 18, 19 supply electrical energy to cathode 16. As shown in FIGS. 1–2 and FIG. 5, anode leads 21, 22 and cathode leads 18, 19 pass through stem 23 at equal radial distances from axis x—x. Leads 18, 19, 21, 22 are metal conductors with circular cross-sections. Cathode leads 18, 19 extend up through stem 23 and parallel to axis x—x to axial positions just below cathode 16.

As shown in FIGS. 1–2, cathode 16 is a solid cylindrical member elongated along axis x—x. Cathode 16 is attached at the center of its downwardly-facing annular surface to support rod 38, which, in turn, is supported by connections to upper cathode strap 35 and lower cathode strap 36. Straps 35, 36 are rectangular cross-bars strung between cathode leads 18, 19 and perpendicular to axis x—x. Support rod 38 is attached to strap 36 at its lower marginal end and is attached to strap 35 near its upper marginal end.

Anode 20 is a cylindrical ring-like member, the outer diameter of which is connected to the upper marginal ends of opposed anode leads 21, 22. Anode leads 21, 22 extend parallel to axis x—x and up through stem 23 to axial positions higher than the upper ends of cathode leads 18, 19. Consequently, anode 20 is positioned above cathode 16. The inner diameter of anode 20 is greater than the outer diameter of cathode 16.

Four circular mica support disks, severally indicated at 33, are arranged around cathode 16. Disks 33 are elongated along axis x—x and are ring-like members. The outer diameter of each support disk 33 is slightly less than the inner diameter of bulb 24. The inner diameter of each support disk 33 is slightly larger than the outer diameter of cathode 16. Anode leads 21, 22 pass through two opposed circular holes in each support disk 33. Support disks 33 are evenly spaced, with the bottom disk positioned near the lower marginal end of cathode 16 and the upper disk positioned slightly higher than the top surface of cathode 16. Four ceramic sleeves, severally indicated at 34, insulate anode leads 20 and provide spacing between the individual support disks 33 and between the top support disk and anode 20. Support disks 33 assist in maintaining the internal structure of hollow cathode lamp 15.

A barium getter 26 is used to collect contaminant gases after the lamp is sealed. As shown in FIG. 2, getter 26 is a cylindrical ring-like member elongated along axis x—x and having an outer diameter less than the transverse distance between cathode leads 18 and 19. Getter 26 is oriented downward and is mounted to and below lower strap 36. It is know in the prior art that a barium getter can extend the service life of the lamp and help guarantee that the lamp's emitted spectrum will not become contaminated with hydrogen, oxygen or water vapor that may diffuse from the internal components after the lamp is evacuated and sealed. Getter 26 is heated by coupling with an RF field until the metal vaporizes onto the inside of the lamp. The barium getter manufactured by Toshiba America, Electronics Components, at 290 Donald Lynch Blvd., Marlborouth, Mass. 01752, part number N-1350M(6), may be employed in the preferred embodiment. As shown in FIGS. **4*a*–4*b*, getter 26 is directional and positioned to flash downward, as indicated by vectors 29. In the prior art designs, as shown in FIG. 4*a*, the barium metal flashes and forms a film on the lower inside portion of bulb 24 and the inside of stem 23. However, this design often allows and results in the flashed barium making electrical contact with the cathode leads, which in turn produces a negative potential in the barium. This unwanted electrical connection occurs predominantly at cathode outlets 25 and 27, where cathode leads 18, 19 pass through stem 23** and into the interior of the lamp.

Figure 3:
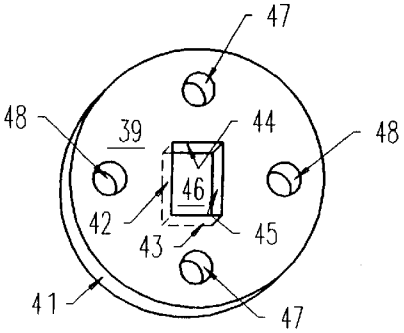
FIG. 3 is a perspective view of the flash shield.

As shown in FIGS. 1 and **4*b*, the improved device incorporates a flash shield 28 to limit the deposition of the barium getter metal on stem 23 and outlets 25, 27. As shown in FIG. 3, flash shield 28 is a circular disk elongated along axis x—x, and is bounded by an upwardly-facing annular horizontal surface 39, a downwardly-facing annular horizontal surface 40 (not shown), an outwardly-facing cylindrical vertical surface 41, and inwardly-facing rectangular vertical planar surfaces 42, 43, 44 and 45. Surfaces 42, 43, 44 and 45 define a rectangular evacuation passage 46. Evacuation passage 46 allows for unrestricted evacuation of the bulb. As shown in FIG. 3, in addition to evacuation passage 46, flash shield 28 also contains two co-axial cathode lead through-bores, severally indicated at 47, and two co-axial anode lead through-bores, severally indicated at 48. In a preferred embodiment, flash shield 28** is composed of nickel and is approximately 0.008 inches thick.

In addition, flash shield 28 is capable of being heated to 1000° C. before the getter flashes. When heated, flash shield 28 provides not only a physical barrier to the barium getter metals, but also a thermodynamic one. When getter 26 flashes, the vaporized barium will tend to move towards lower temperatures and away from the heated flash shield 28, thereby limiting the contact of barium below flash shield 28 and on stem 23 and cathode outlets 25, 27.

As shown in FIG. **4*b*, stem 23 includes glass protrusions, severally indicated at 50, at cathode outlets 25, 27 and anode outlets 49. Cathode leads 18, 19 and anode leads 21, 22 are chemically bonded to glass stem 23 at their contacting surfaces. Glass protrusions 50 provide added surface area to facilitate an airtight chemical connection between the leads and the contacting glass stem. Four ceramic sleeves, severally indicated at 51, insulate leads 18, 19, 21, 22 as they exit from stem 23. Sleeves 51 also act to support flash shield 28. As shown in FIG. 1, flash shield 28 rests on the upwardly-facing annular horizontal surface of cylindrical sleeves 51. To provide additional stability, an adhesive may be used between flash shield 28 and the upwardly-facing annular vertical surfaces of sleeves 51. Flash shield 28 is also held in place by anode sleeves 31, which insulate anode leads 21, 22 between the top of flash shield 28 and the lowest support disk 33. Cathode sleeves 32 insulate cathode leads 18, 19 between the top of flash shield 28 and an axial position just above getter 26**.

Figure 4B:
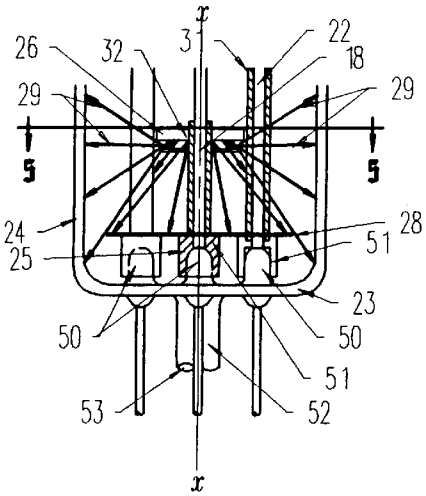
FIG. 4*b* is a fragmentary elevation showing the bottom marginal end of the improved hollow cathode lamp and indicating the vectors of flashing getter metal.
Figure 4A:
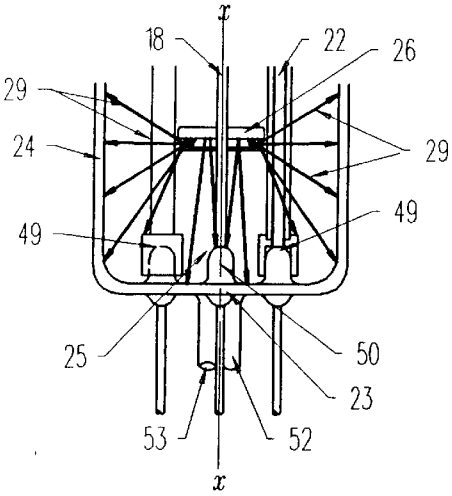
FIG. 4*a* is a fragmentary view showing the bottom marginal end portion of a hollow cathode lamp known in the prior art and indicating the vectors of flashing getter metal in the prior art.

FIG. 5 is a sectional view of the hollow cathode lamp shown in FIG. **4*b*, taken generally on line 5—5 of FIG. 4*b*. FIG. 5 shows the opposed co-axial orientation of cathode leads 18, 19 and anode leads 21, 22. This orientation provides mechanical stability to hollow cathode lamp 15. FIG. 5 also shows sleeves 31 and 32, getter 26, flash shield 28, rectangular evacuation passage 46, and axial through-bore 53**.

As shown in FIG. **4*b*, an exhaust tube 52 extends from and below stem 21. Tube 52 is a cylindrical glass member. An axial through-bore 53 is cut through stem 21 and has a diameter equal to the inner diameter of tube 52. Upon evacuation of bulb 24, tube 52 is melted to form a frusto-conical seal of axial stem through-bore 53**.

As illustrated in FIG. 4*b*, flash shield 28 limits the deposit of barium metal on stem 23 and cathode outlets 25 and 27. Because the barium does not contact the cathode leads when it flashes, it does not become charged, does not achieve a negative potential, and does not act as the cathode when the lamp discharges. Consequently, the desired spectra is emitted during discharge of hollow cathode lamp 15.

Modifications

The present invention contemplates that many changes and modifications may be made. The particular materials of which the various body parts and component parts are formed are not deemed critical and may be readily varied. The shape and dimensions of the component parts, including the flash shield, may also be readily varied.

Therefore, while the presently-preferred form of the hollow cathode lamp has been shown and described, and several modifications discussed, persons skilled in the art will readily appreciate that various additional changes and modifications may be made without departing from the spirit of the invention, as defined and differentiated by the following claims.

What is claimed is:

1. A hollow cathode lamp comprising:

a stem;

a cathode lead passing through the stem;

a directional getter that is positioned to substantially flash towards the stem; and a flash shield positioned between the getter and the stem to limit the deposit of getter metal on the stem and the cathode lead when the getter flashes.

2. The hollow cathode lamp according to claim 1 wherein the flash shield is a circular disc.

3. The hollow cathode lamp according to claim 1 wherein the flash shield is composed of nickel.

4. The hollow cathode lamp according to claim 1 wherein the flash shield includes an evacuation passage.

5. The hollow cathode lamp according to claim 1 wherein the flash shield is capable of being heated to about 1000° C. during flashing so as to convectionally repel the getter metal when the getter flashes.

6. A hollow cathode lamp comprising:

a stem;

a cathode lead passing through the stem;

a getter; and a flash shield spaced away from the getter and positioned between the getter and the stem that limits the deposit of getter metal that is flashed towards the stem.

7. The hollow cathode lamp according to claim 6 wherein the flash shield is a circular disc.

8. The hollow cathode lamp according to claim 6 wherein the flash shield is composed of nickel.

9. The hollow cathode lamp according to claim 6 wherein the flash shield includes an evacuation passage.

10. The hollow cathode lamp according to claim 6 wherein the flash shield is capable of being heated to about 1000° C. during flashing so as to convectionally repel the getter metal when the getter flashes.

11. The hollow cathode lamp according to claim 6 wherein the getter is a directional getter that is positioned to substantially flash towards the stem.

12. A hollow cathode lamp comprising:

a stem;

a cathode lead passing through the stem;

a getter; and a flash shield with an evacuation passage, positioned between the getter and the stem, which limits the deposit of getter metal on the stem and the cathode lead when the getter flashes.

13. The hollow cathode lamp according to claim 12 herein the flash shield is a circular disc.

14. The hollow cathode lamp according to claim 12 wherein the flash shield is composed of nickel.

15. The hollow cathode lamp according to claim 12 wherein the flash shield is capable of being heated to about 1000° C. during flashing so as to convectionally repel the getter metal when the getter flashes.

16. The hollow cathode lamp according to claim 12 wherein the flash shield is spaced away from the getter.

17. The hollow cathode lamp according to claim 12 wherein the getter is a directional getter that is positioned to substantially flash towards the stem.

* * * * *